United States Patent [19]

Aoki

[11] Patent Number: 4,580,543

[45] Date of Patent: Apr. 8, 1986

[54] VENTILATOR FOR INTERNAL COMBUSTION ENGINE

[75] Inventor: Kongo Aoki, Toyota, Japan

[73] Assignee: Aisin Seiki Kabushiki Kaisha, Kariya, Japan

[21] Appl. No.: 699,139

[22] Filed: Feb. 7, 1985

[30] Foreign Application Priority Data

Mar. 2, 1984 [JP] Japan ..... 59-040973

[51] Int. Cl.[4] ..... F02B 25/06

[52] U.S. Cl. ..... 123/574; 123/573; 137/204

[58] Field of Search ..... 123/572, 574, 573, 41.86; 137/204, 859, 860, 843, 854

[56] References Cited

U.S. PATENT DOCUMENTS

| | | | |
|---|---|---|---|
| 1,427,337 | 8/1922 | Tracy | 123/573 |
| 2,450,864 | 10/1948 | Callaway et al. | 123/574 |
| 2,731,958 | 1/1956 | Robley | 123/573 |
| 3,073,293 | 1/1963 | Barker | 123/572 |
| 3,144,011 | 8/1964 | Anthes | 123/57 X |
| 3,179,097 | 4/1965 | Jackson | 123/574 |
| 4,453,525 | 6/1984 | De Bruler | 123/572 |

*Primary Examiner*—Magdalen Y. C. Moy

*Attorney, Agent, or Firm*—Oblon, Fisher, Spivak, McClelland & Maier

[57] ABSTRACT

A ventilator for use with an internal combustion engine includes an oil sump located at the lower end of the vertically extending outlet tube of the ventilator, a check valve disposed at the bottom of the sump for allowing fluid to flow from the sump toward the pressure chamber of the ventilator, and an outlet port extending out through the side wall of the outlet tube. The outlet tube is in communication with an intake manifold via the outlet port. The oil sump cooperates with the check valve to prevent oil from flowing into the intake manifold through the outlet port.

4 Claims, 2 Drawing Figures

VENTILATOR FOR INTERNAL COMBUSTION ENGINE

FIELD OF THE INVENTION

The present invention relates to a ventilator for an internal combustion engine and, more particularly, to a ventilator which introduces blowby gas inside a crankcase into an intake manifold to control the pressure inside the crankcase.

BACKGROUND OF THE INVENTION

A conventional ventilator of this kind for use with an internal combustion engine is disclosed in U.S. Pat. No. 3,144,011. As shown in FIG. 1, this ventilator 10 consists basically of a housing 12 and a diaphragm 11 that divides the interior of the housing into a pressure chamber 13 and an atmospheric chamber 14. The pressure chamber 13 is in communication with a crankcase via an inlet port 15. The atmospheric chamber 14 is in communication with an atmospheric source via an atmospheric port 16. An outlet tube 17 extends vertically within the pressure chamber 13, and is in communication with an intake manifold via an outlet port 18. The outlet tube 17 is opened or closed by a valve 19 fixedly secured to the diaphragm 11. The quantity of blowby gas that is introduced into the outlet tube 17 from the pressure chamber 13 can be controlled by the valve 19.

In the aforementioned prior art ventilator for an internal combustion engine, the blowby gas from the crankcase is forced into the intake manifold through the ventilator. To prevent lubricating oil added to the blowby gas from entering the intake manifold, the blowby gas in the crankcase is directed into the pressure chamber 13 of the ventilator 10 via an oil separator, which, as well known in the prior art, acts to separate oil component from lubricating oil added to the blowby gas. However, it is difficult to completely separate oil component with an oil separator. Hence, blowby gas containing oil component left unseparated intrudes into the pressure chamber 13 of the ventilator. When the valve 19 is open, this gas still containing the oil component is admitted to the intake manifold through the outlet tube 17.

When the oil separator separates oil component incompletely in this way, all the oil component introduced into the ventilator will intrude into the intake manifold, increasing the quantity of lubricating oil consumed. Further, the engine becomes contaminated and, therefore, various sensors and other devices installed on the manifold are contaminated, resulting in their malfunction.

SUMMARY OF THE INVENTION

Accordingly, it is the main object of the present invention to provide a ventilator which eliminates the possibility that lubricating oil which is added to blowby gas flowing in the pressure chamber of the ventilator flows into an intake manifold through the outlet tube.

This object is achieved by a ventilator comprising: an outlet tube extending vertically; an oil sump located at the lower end of the outlet tube and having a certain capacity; a check valve mounted at the bottom of the oil sump to allow fluid to flow from the oil sump toward the pressure chamber of the ventilator; and an outlet port formed through the side wall of the outlet tube and protruding radially outwardly, the outlet tube being in communication with an intake manifold via the outlet tube.

The blowby gas which has entered the pressure chamber is caused to flow toward the outlet port through the outlet tube when the valve is open. At this time, the blowby gas flows downwardly through the outlet tube and changes its direction abruptly toward the outlet port. Therefore, the oil added to the blowby gas is separated from the gas and temporarily stored in the oil sump located at the lower end of the outlet tube. When the engine is at rest, i.e., the pressure inside the crankcase is null, or is running at a low speed, i.e., the pressure is low, the weight of the oil itself in the sump opens the check valve. Thus, the oil flows into the pressure chamber and then returns to the crankcase. In this way, even when the blowby gas containing oil flows into the pressure chamber, the oil sump cooperates with the check valve to prevent the oil from flowing into the intake manifold through the outlet port.

According to the invention, the oil in the sump is allowed to flow into the pressure chamber via the check valve. Another structure might be contemplated in which a return passage is provided in the outlet tube for communication of the oil sump with the pressure chamber such that the oil in the sump flows into the pressure chamber through the passage. In this structure, however, when the engine is stopped and the pressure inside the crankcase drops to zero, the oil in the sump drains into the pressure chamber through the return passage. When the engine is running and some pressure exists inside the crankcase, this internal pressure directly acts on the return passage. The result is that the oil in the sump is splashed into the outlet tube and then some of the oil flows toward the intake manifold.

In contrast, in the ventilator according to the invention, the check valve keeps fluid from moving from the pressure chamber toward the outlet tube. Therefore, while the engine is running, the pressure inside the crankcase does not directly act on the inside of the oil sump. Even if the pressure within the crankcase is increased to a high value, this high pressure does not work on the inside of the sump. Consequently, there arises no possibility that the oil in the sump is splashed into the outlet tube. This prevents the oil from draining into the intake manifold from the outlet tube.

Other objects and features of the invention will appear in the course of the description thereof which follows.

DETAILED DESCRIPTION OF THE INVENTION

Figure 1:
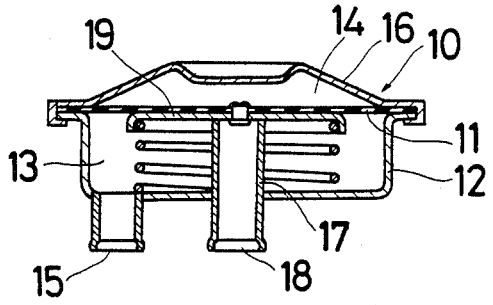
FIG. 1 PRIOR ART
FIG. 1 is a cross-sectional view of a conventional ventilator.
Figure 2:
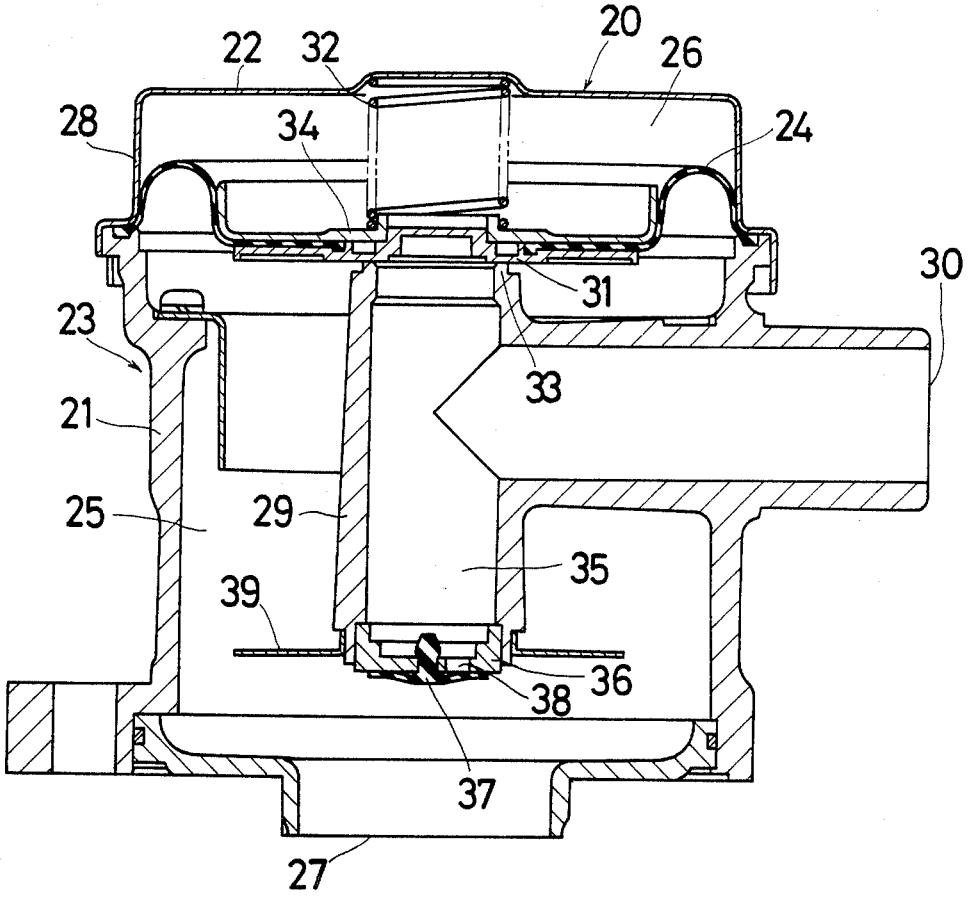
FIG. 2 is a cross-sectional view of a ventilator according to the present invention.

Referring to FIG. 2, there is shown a ventilator embodying the concept of the present invention. This ventilator, generally indicated by numeral 20, for use with an internal combustion engine has a body 21 and a cover 22 fixed to the body to form a housing 23. A flexible diaphragm 24 has its outer peripheral portion sandwiched between the body 21 and the cover 22 in an airtight manner. The diaphragm 24 divides the inside of the housing 23 into a pressure chamber 25 and an atmospheric chamber 26. The pressure chamber 25 is always in communication with a crankcase (not shown) via an inlet port 27 formed at the lower end of the body 21. The atmospheric chamber 26 invariably communicates with an atmospheric source by way of an atmospheric port 28 formed in the cover 22.

An outlet tube 29 extends vertically in the pressure chamber 25. An outlet port 30 is formed through the side wall of the tube 29 and protrudes radially outwardly. The outlet tube 29 is in communication with an intake manifold (not shown) through the outlet port 30. As can be seen from the figure, the tube 29 is formed integrally with the body 21. The opening at the upper end of the outlet tube 29 is opened or closed by a valve 31 that is fixedly secured to the diaphragm 24. The valve 31 is always urged into engagement with a seat surface at the upper end of the outlet tube 29, by the action of a spring 32 mounted in the atmospheric chamber 26. The spring 32 is held by a retainer 34 which is firmly fixed to the valve 31. The retainer 34 cooperates with the valve 31 to hermetically seal the inner portion of the diaphragm 24 to the body.

An oil sump 35 having a given capacity is mounted at the lower end of the outlet tube 29. A poppet valve 37 is mounted in an insert member 36 which is affixed at the bottom of the sump 35, i.e., at the lower end of the outlet tube 29. The valve 37 permits fluid to flow from the sump 35 toward the pressure chamber 25. When the valve 37 is open, the oil in the sump 35 flows into the pressure chamber 25 through a passage 38. A baffle member 39 that is anchored to the lower end of the outer periphery of the outlet tube 29 serves to separate oil component contained in the blowby gas which is drawn in through the inlet port 27.

When the pressure inside the crankcase increases beyond a predetermined value, this internal pressure acts on the pressure chamber 25, moving the diaphragm 24 upward as viewed in the figure against the action of the spring 32. At the same time, the valve 31 fixed to the diaphragm 24 is shifted upward and held at a distance from the seat surface 33. Thus, blowby gas flows into the outlet tube 29 from the pressure chamber 25, and then passes through the outlet port 30 into the intake manifold. After traveling downwardly through the outlet tube 29, the blowby gas changes its direction abruptly and is directed into the outlet port 30. At this time, the oil particles contained in the gas separate from the gas by their own weight. Then, the particles drop into the sump 35 and are stored there temporarily. Subsequently, when the engine is at rest or running at a low speed, the poppet valve 37 is opened by the weight of the oil itself in the sump 35. The oil stored in the sump 35 is then allowed to flow into the pressure chamber 25, after which it returns into the crankcase.

In the present example, the check valve 37 takes the form of a poppet valve utilizing the resilience of rubber. Obviously, a valve making use of a spring may also be used as the check valve.

What is claimed is:

1. A ventilator for an internal combustion engine, comprising:

a housing;

a diaphragm that divides the inside of the housing into a pressure chamber communicating with a crankcase and an atmospheric chamber communicating with the atmosphere;

an outlet tube extending vertically in the pressure chamber and communicating with an intake manifold;

a valve fixed to the diaphragm and acting to open or close an opening at an upper end of the outlet tube for controlling the quantity of blowby gas introduced into the outlet tube from the pressure chamber;

an oil sump located at a lower end of the outlet tube and having a given capacity;

a check valve mounted at the bottom of the oil sump to allow fluid to flow from the sump toward the pressure chamber; and an outlet port formed through the side wall of the outlet tube and protruding radially outwardly, the outlet tube being in communication with the intake manifold via the outlet port.

2. The ventilator of claim 1, wherein the outlet tube is formed integrally with the body of the housing.

3. The ventilator of claim 1, wherein a baffle member is fixed to the lower end of the outer peripheral portion of the outlet tube, whereby oil component contained in the blowby gas that is drawn in through the inlet port is separated.

4. The ventilator of claim 1, wherein the check valve is a poppet valve made from rubber.

* * * * *